US006295036B1

(12) United States Patent
Mata et al.

(10) Patent No.: US 6,295,036 B1
(45) Date of Patent: Sep. 25, 2001

(54) RETAINER FOR SUPPORTING A DEVICE ON A MOUNTING SURFACE AND METHOD FOR MOUNTING A DEVICE ON A MOUNTING SURFACE

(75) Inventors: Rizaldy B. Mata, Milwaukee; Kevin W. Peterson; Scott T. Surges, both of Nashotah, all of WI (US)

(73) Assignee: General Electric Company, Milwaukee, WI (US)

( * ) Notice: Subject to any disclaimer, the term of this patent is extended or adjusted under 35 U.S.C. 154(b) by 0 days.

(21) Appl. No.: 09/589,977

(22) Filed: Jun. 8, 2000

(51) Int. Cl.[7] ..... E04B 1/40
(52) U.S. Cl. ..... 343/878; 52/238.1
(58) Field of Search ..... 343/878, 700 MS; 52/238.1, 715; 174/152 R

(56) References Cited

U.S. PATENT DOCUMENTS

| | | | | |
|---|---|---|---|---|
| 4,015,388 | | 4/1977 | Hemminger | 52/395 |
| 4,264,048 | | 4/1981 | Silbernagel et al. | 248/229.17 |
| 4,611,093 | * | 9/1986 | Farmer et al. | 174/152 |
| 4,642,859 | | 2/1987 | Kaiser | 24/669 |
| 4,754,533 | | 7/1988 | Awakowicz et al. | 24/458 |
| 4,838,002 | * | 6/1989 | Dajnko et al. | 52/489 |
| 5,099,549 | | 3/1992 | Hullmann et al. | 24/295 |
| 5,294,189 | * | 3/1994 | Price et al. | 301/37.37 |
| 5,456,138 | | 10/1995 | Nutile et al. | 74/594.6 |
| 5,598,682 | | 2/1997 | Haughian | 52/745.21 |
| 5,661,264 | * | 8/1997 | Reiker | 174/50 |
| 5,700,083 | | 12/1997 | Boechel | 362/249 |
| 5,842,450 | | 12/1998 | Fort et al. | 123/463 |
| 6,124,829 | * | 9/2000 | Iwasaki | 343/700 MS |

* cited by examiner

*Primary Examiner*—Don Wong
*Assistant Examiner*—James Clinger
(74) *Attorney, Agent, or Firm*—Timothy J. Ziolkowski; Christian G. Cabou; Phyllis Y. Price

(57) ABSTRACT

A retainer includes a base portion, a plurality of prongs, and a retention clip. The base portion has an inner bore engageable with a threaded stud extending from the mounting surface. The prongs extend outwardly from the base portion and are slidable into a bore of a device to be mounted to the mounting surface. The retention clip is formed by an outer distal end portion of the prongs and is configured to retain the device on the mounting surface by snap-locking onto the device when the device is slid onto the retainer. The prongs outer distal ends that are compressibly spaced apart from one another. In order to facilitate release of the device from the mounting surface, a pair of finger pads may be located at the outer distal ends of the prongs. The retainer is well-suited for mounting a telemetry antenna on a surface such as a ceiling and, in fact, can reduce antenna installation time by 75% when compare to prior known systems.

22 Claims, 4 Drawing Sheets

RETAINER FOR SUPPORTING A DEVICE ON A MOUNTING SURFACE AND METHOD FOR MOUNTING A DEVICE ON A MOUNTING SURFACE

BACKGROUND OF THE INVENTION

The present invention relates generally to retainers and, and more particularly to a retainer for mounting a device such as a telemetry antenna on a mounting surface such as a ceiling. The invention additionally relates to an antenna mounting system and to a method for detachably mounting an antenna on a ceiling.

Retainers for mounting devices on mounting surfaces are well known. Known retainers include screws, bolts, rivets, straps, and cotter pins. Although these devices work reasonably well for their intended purpose, their use usually requires considerable effort and/or specialized tools. They also usually cannot be easily removed. For instance, retaining clips or pins often must be bent to attach the device to the underlying mounting surface and must be straightened before the device can be removed from the mounting surface. At least a portion of most retainers also must be completely removed to permit removal of the device from the mounting surface and are easily lost. Some snap-fit retainers need not be removed to permit detachment of the device from the mounting surface, but they are often difficult to unsnap without the use of a relatively specialized tool such as a needle-nose pliers.

These problems are particularly evident where the retainer is in the form of a clip that is used to mount a device on a ceiling at a location above obstructions that render it difficult to access the retainer. For instance, some medical monitoring systems employ several ceiling-mounted telemetry antennas to track and monitor patients. These antennas often were affixed directly to the associated retainer, e.g., by screwing a threaded boss on the antenna directly onto a treaded stud of the retainer. Mounting these antennas on a ceiling using conventional retainer clips often is hindered by equipment within the room. Installing or removing such antennas using pliers, wrenches, and/or other tools can be a very time consuming process that substantially increases the overall systems' installation or removal costs.

In view of the aforementioned problems, the need has arisen to provide a retainer that permits a device such as a telemetry antenna to be mounted on and taken off from the associated mounting surface quickly and easily without the use of any specialized tools. The need has also arisen to provide an easily implemental method of mounting a device such as a telemetry antenna on an associated mounting surface such as a ceiling.

SUMMARY OF THE INVENTION

The present invention provides a system and a method for detachably mounting a device on a mounting surface that 1) simplifies the installation procedure, 2) enhances the operating performance of the mounted device, 3) minimizes installation time, 4) reduces installation cost, and 5) requires no specialized tools for installation or removal of the device.

In accordance with a first aspect of the invention, a retainer is provided that includes a base portion, a plurality of prongs, and a retention clip. The base portion has an inner bore engageable with a threaded stud extending from the mounting surface. The prongs extend outwardly from the base portion and are slidable into a bore of a device to be mounted to the mounting surface. The retention clip is formed by an outer distal end portion of the prongs and is configured to retain the device on the mounting surface by snap-locking onto the device when the device is slid onto the retainer. The outer distal ends of the prongs are compressibly spaced apart from one another to facilitate a snap-fit connection with the device. Additional prongs could also be provided. In order to facilitate release of the device from the mounting surface, a pair of finger pads may be located at the outer distal ends of the prongs. Each finger pad preferably has a concave face to assist in compressing the two prongs to release the device from the mounting surface.

The mounting surface may comprise a ceiling grid. In this case, the retainer preferably further comprises a T-bar clip attachable to the ceiling grid and having the threaded stud that is engageable with the inner bore of the base portion.

Alternatively, the support structure could comprise a ceiling tile. In this case, the retainer preferably further comprises a ceiling bracket, a T-bar clip, and a ceiling washer and wing nut. The ceiling bracket includes a stud extendable through the ceiling tile. The T-bar clip is engageable with the ceiling bracket and includes the stud that is engageable with the inner bore of the base portion. The ceiling washer and wing nut are engageable to the stud of the ceiling bracket to mount the retainer to the mounting surface.

Alternatively, the mounting structure could comprise a solid surface. In this case, the retainer preferably comprises an anchor inserted into the solid surface and a hanger bolt having an inner end attached to the anchor and having an outer end that forms the stud that is engageable with the inner bore of the base portion.

In accordance with another aspect of the invention, a telemetry antenna mounting system includes an antenna having a bore therethrough, a support structure, and a retaining clip. The support structure is attachable to a mounting surface and has a threaded stud extending therefrom. The retaining clip includes a base portion, a plurality of prongs, and a retention clip. The base portion has an inner bore engageable with a stud extending from the ceiling. The prongs extend outwardly from the base portion and are slidable into a bore of the antenna. The retention clip is formed by an outer distal end portion of the prongs and is configured to retain to the antenna on the ceiling by snaplocking onto the antenna when the antenna is slid onto the retainer clip.

In accordance with yet another aspect of the invention, a method of mounting an antenna to a structure includes the steps of securing a support structure to the surface, screwing an internally threaded base portion of a retaining clip onto a threaded stud of the support structure, sliding the antenna over a plurality of prongs attached to and extending from the base portion end of the retaining clip, and snap-locking the antenna to a retention clip attached to and extending outwardly from the plurality of prongs to retain the antenna to the ceiling. Preferably, the retaining clip is threaded further onto the threaded post after snap-locking the antenna to the retention clip to draw the antenna snug against the surface. The antenna can subsequently be released from the retaining clip by compressing the plurality of prongs inwardly to disengage the retention clip of the retaining clip from the antenna.

Various other features, objects and advantages of the present invention will be made apparent from the following detailed description and the drawings.

BRIEF DESCRIPTION OF THE DRAWINGS

Preferred exemplary embodiments of the invention are illustrated in the attached drawings in which like reference numerals represent like parts throughout and in which.

DETAILED DESCRIPTION OF THE PREFERRED EMBODIMENTS

Figure 1:
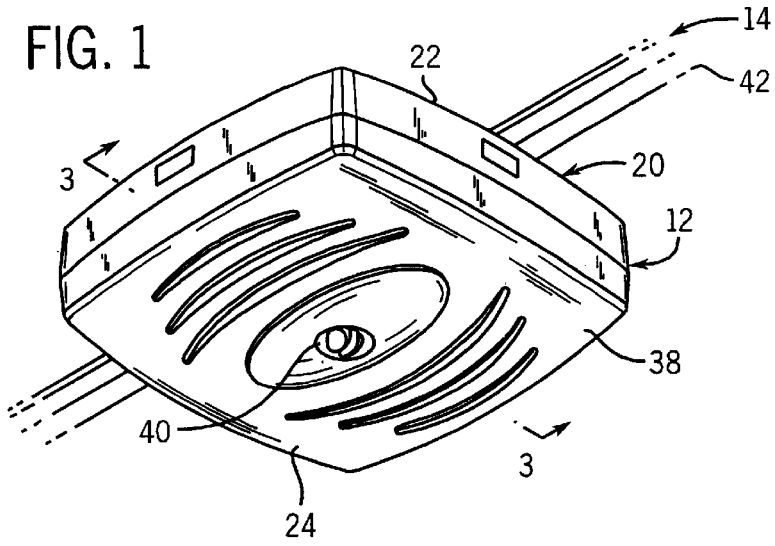
FIG. 1 is a perspective view of a telemetry antenna mounted on a ceiling using a retainer constructed in accordance with a first preferred embodiment of the present invention.
Figure 2:
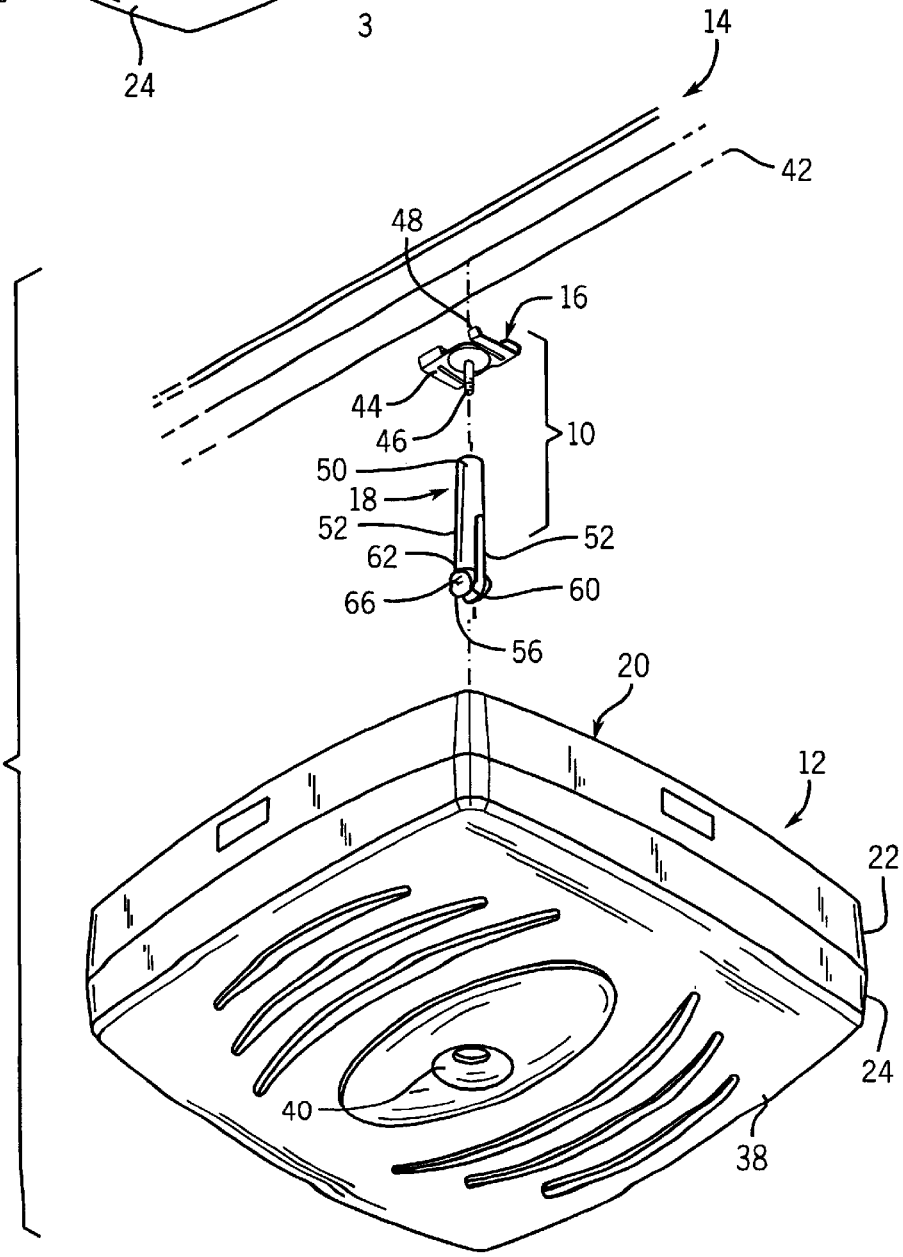
FIG. 2 is an exploded perspective view of the antenna and retainer of FIG. 1.
Figure 3:
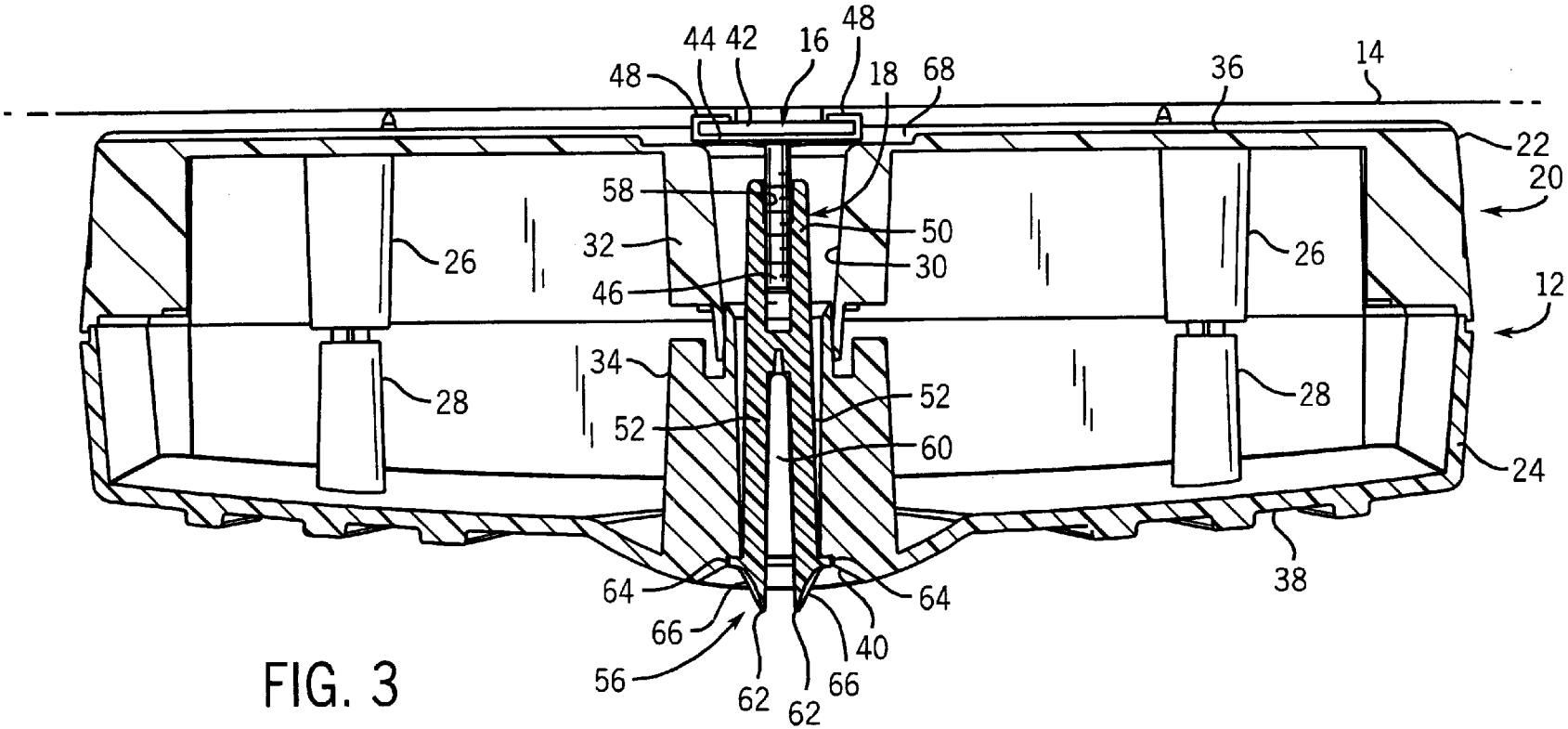
FIG. 3 is a sectional elevation view of the telemetry antenna and retainer of FIG. 1.

Referring to the drawings and initially to FIGS. 1–3, a retainer 10 is illustrated that is used to detachably mount a device such as telemetry antenna 12 on a mounting surface. The mounting surface may comprise a wall or other vertical structure or a horizontal structure such as a ceiling 14. The retainer 10 includes an upper support structure 16 configured for mounting on the ceiling 14 and a lower retaining clip 18 configured to be mounted on the support structure 16 and to support the antenna 12 in a releasable snap-fit manner.

The antenna 12 is used to track the locations of patients wearing transmitters and to obtain data from those patients. Still referring to FIGS. 1–3, antenna 12 includes a two-part housing 20 having upper and lower sections 22 and 24 coupled to one another by upper and lower connecting posts 26 and 28. A bore 30 extends vertically through mating bosses 32 and 34 extending into the interior of the housing 20 from respective upper and lower surfaces 36 and 38 of the housing 20. The bore 30 is sufficiently wide to permit free sliding movement of the housing 20 over the retaining clip 18 in the retaining clip's uncompressed state. The bottom surface 38 of the housing 20 is chamfered in the vicinity of the bore at 40 to provide an annular seat for engagement with a clip portion 56 of the retaining clip 18 as detailed below.

The construction and manner of operation of the support structure 16 will vary from application to application, depending on the construction of the ceiling or other mounting structure supporting the retainer 10. In addition, the orientation of the retainer 10 and antenna 12 will vary depending on whether the antenna 12 is mounted on a vertical surface such as a wall or a horizontal surface such as a ceiling. In the illustrated embodiments of FIGS. 1–5, the antenna 12 is mounted on a ceiling, in which case the major components of the retainer 10 extend vertically. Terminology such as "downwardly" and "above" therefore is used herein for the sake of convenience. The invention should not be construed to require those or any other orientations.

The ceiling 14 of the embodiment of FIGS. 1–3 includes a ceiling grid having a channel 42. The support structure 16 therefore is adapted for mounting on the channel 42 of the ceiling grid. It comprises a T-bar clip having a generally horizontal base 44 and a threaded stud 46 extending downwardly from the base 44. The base 44 includes flexible clips 48 that clip onto the channel 42 in a conventional manner. The stud 46 extends downwardly from the base 44 and is threaded at its distal end.

The retaining clip 18 is configured to be attachable to the support structure 16 and to permit the attachment of the antenna 12 thereto and removal of the antenna 12 therefrom without the use of any specialized tools. It is also formed from a relatively resilient, light-weight, low-cost material such an injection molded plastic. The use of a plastic material for the retaining clip 18 also helps minimize any negative impact of the retaining clip 18 on the antenna's gain pattern.

Referring to FIGS. 2 and 3, the retaining clip 18 includes an upper base portion 50, at least two prongs 52 disposed beneath the base portion 50, and a retention clip portion 56 disposed at the bottom distal end of the prongs 52. The base portion 50, which is tapered outwardly from its upper to lower ends, has an internally threaded inner bore 58 or internally threaded insert engageable with and threadable onto the threaded stud 46 of the ceiling clip 16. The prongs 52 are formed from an extension of the base 50 and, therefore, taper at least generally at the same angle as the base 50. They extend downwardly from the base portion 50 and are configured to be slidable into the bore 30 of the antenna housing 20. The prongs 52 are separated from one another by an axial slot 60 that permits the prongs 52 to resiliently reflect towards and away from one another during an antenna installation or removal process. The bottom end of the slot 60 also serves as a mating surface for a tool such as a screwdriver or coin as detailed below. Although the retaining clip 18 of the illustrated embodiment has only two prongs, a retaining clip having three or more prongs could also be employed, so long as the prongs can be compressed towards one another for antenna installation and removal.

The retention clip portion 56 of the retainer clip 18 extends horizontally outwardly from the lower distal ends of the prongs 52 to capture and retain the antenna 12 to the ceiling 14 or other mounting surface. The retention clip portion 56 includes two identical clip portions 62, one of which is formed on the lower end of each of the respective prongs 52. Each clip portion 62 has an upper, outwardly extending lip 64 configured to engage the seat formed by the chamfered portion 40 of the bottom surface 38 of the antenna housing 20. A finger pad 66 extends downwardly from each lip 64 to the bottom distal end of the associated prong 52. Each of the finger pads 66 has a concave face to assist in compressing the prongs 52 towards one another during an antenna installation or removal process. The entire clip portion 56 is tapered inwardly from its upper end to its lower end to aid in an antenna installation process.

The telemetry antenna 12 can be mounted on the ceiling 14 using the retainer 10 in the following process. First, the T-bar clip 16 is affixed to the ceiling grid channel 42, using the flexible clips 48 of the base 44 of the clip 16, such that the threaded stud 46 extends vertically downwardly from the ceiling 14. The base portion 50 of the retaining clip 18 is then threaded part-way onto the threaded stud 46 of the T-bar clip 16. The antenna 12 is then simply snapped onto the end of the retaining clip 18. Specifically, as the central bore 30 in the antenna housing 20 is pressed upwardly over the retaining clip 18, engagement of the tapered retainer clip portion 56 of the retaining clip 18 with the edge of the bore 30 compresses the prongs 52 and permits additional upward movement of the antenna 12 relative to the retaining clip 18. When the lips 64 of the retention clip portion 56 clear the bottom end of the bore 30, the prongs 52 resiliently snap back to their uncompressed position so that the lips 64 rest against the annular seat formed by the chamfered portion 40 of the bottom surface 38 of the antenna housing 20 to hold the antenna 12 in the position illustrated in FIGS. 1 and 3.

A flathead screwdriver or even a coin (not shown) can then be inserted into the bottom of the slot 60 and turned to tighten the retaining clip 18 further onto the stud 46 until the antenna 12 rests snuggly against the ceiling 14. It could also be finger-tightened against the ceiling. This snug-fit is assured by providing a recess 68 in the upper surface 36 of the antenna housing 20 that overlies the ceiling clip 16 as illustrated in FIG. 3. Alternatively, the retaining clip 18 could be threaded the proper distance onto the stud 46 for snug fit of the antenna 12 against the ceiling 14 before the antenna 12 is snapped onto the retaining clip 18, thereby negating the need to use any tools whatsoever to mount the antenna 12 on the retainer 10.

A previously-installed telemetry antenna 12 can also be removed for relocation or replacement in a very simple operation without using any complex tools. All one need do is to grip the finger pads 66 on the retention clip 56 and press them towards one another to compress the prongs 52 sufficiently to permit the lips 64 to move into the bore 30 of the antenna housing 20, at which time the antenna 12 simply slips off from the end of the retaining clip 18.

Because use of the retainer 10 permits a telemetry antenna 12 or other structure to be mounted on a ceiling 14 or other mounting surface very rapidly without using special tools and little or no skilled labor, the retainer 10 minimizes installation time, reduces installation costs, and greatly facilitates removal and relocation of the mounted device when compared to prior known mounting systems. In fact, it is estimated that the retainer 10 yields a 75% reduction in installation time when compared to prior retainers used in these applications.

Figure 4:
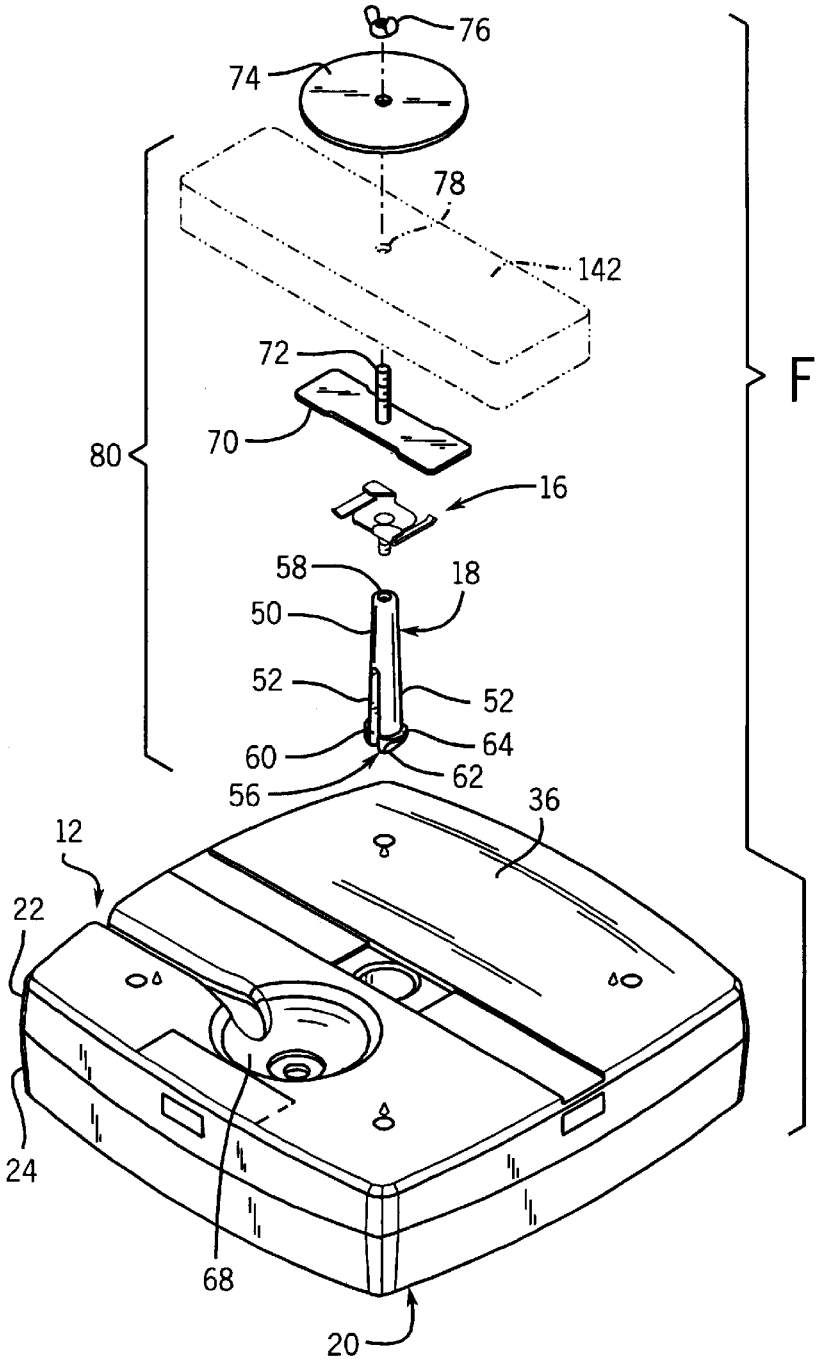
FIG. 4 is an exploded perspective view of a telemetry antenna and a retainer constructed in accordance with a second preferred embodiment of the present invention.

Referring now to FIG. 4, a retainer 80 constructed in accordance with a second embodiment of the invention differs from the retainer 10 of the first embodiment only in that it is configured for mounting on a thin structure such as a ceiling tile 142 as opposed to a channel such as a ceiling grid channel. Retainer 80 includes the same T-bar clip 16 and retaining clip 18 as in the prior embodiment. However, rather than mounting the T-bar clip 16 directly to a channel on the ceiling, the support structure additionally includes a ceiling bracket assembly that supports the T-bar clip 16. The ceiling bracket assembly includes a support plate 70, a threaded stud 72, a washer 74, and a wing nut 76. The support plate 70 comprises a flat plate that is configured to receive the base 44 of the T-bar clip 16 in the same manner that the ceiling grid bracket of the previous embodiment received the ceiling grid T-bar clip. The stud 72 has a lower end affixed to the support plate 70 and an upper, threaded end dimensioned for protrusion through a hole 78 in the ceiling tile 142 when the support plate 70 is pressed flat against the bottom of the ceiling tile 142.

The T-bar clip 16 is mounted on the ceiling tile 142 by inserting the stud 72 through the hole 78 in the ceiling tile 142, then slipping the washer 74 over the threaded end of the stud 72, and then tightening the wing nut 76 onto the stud 72 to clamp the support plate 70 firmly against the bottom of the ceiling tile 142. The T-bar clip 16 can be clipped onto the support plate 70 (either before or after the support plate 70 is clamped against the ceiling tile 142) in the same manner as discussed above in connection with the first embodiment. Antenna installation then proceeds as before, with the retaining clip 18 first being threaded onto the stud 46 of the T-bar clip 16, the antenna 12 then snapping over the end of the retaining clip 18. Then, if desired or necessary, the retaining clip 16 may be threaded further onto the T-bar clip 16 using a screwdriver or coin to draw the antenna 12 snug to the ceiling tile 142.

Figure 5:
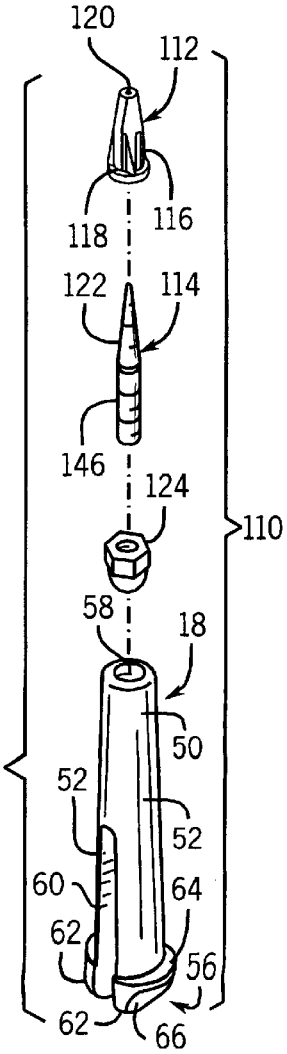
FIG. 5 is an exploded perspective view of a telemetry antenna and a retainer constructed in accordance with a third preferred embodiment of the present invention.

Referring now to FIG. 5, a retainer 110 is illustrated that is constructed in accordance with a third embodiment of the invention and that differs from the retainers of the previous embodiments only in that it is configured for attachment to a drywall or masonry surface (not shown). In this embodiment, the T-bar clip is eliminated altogether and is replaced with an anchor 112 and a hanger bolt 114. The anchor 112 has external ribs 116 and an annular flange 118. When installed in a ceiling, the ribs 116 lock the anchor 112 to the ceiling when it is inserted into a hole in the ceiling. The flange 118 rests flush against the ceiling to prevent further movement of the anchor 112 into the ceiling during an anchor installation process. The anchor 112 also has a tapered threaded internal bore 120 for receiving the hanger bolt 114. The hanger bolt 114, which is threaded along its entire length, has an upper, tapered end 122 configured for mating with the tapered bore 120 in the anchor 112 and a lower end of constant diameter that forms a stud 146 for receiving the retaining clip 18. It should be noted that the anchor 112 is not necessary if the hanger bolt 114 is attached directly to a stud or other rigid structure.

The telemetry antenna 12 is installed using the retainer 110 of FIG. 5 in the following manner. First, a hole (not shown) is drilled in the drywall or masonry surface (also not shown) at the appropriate location. The anchor 112 is then inserted into the hole so that the flange 118 rests flat against the ceiling. An acorn nut 124 is then screwed onto the stud 146 formed by the lower end of the hanger bolt 114, and the tapered upper end 122 of the hanger bolt 114 is inserted into the anchor 112. The acorn nut 124 is then turned to firmly screw the hanger bolt 114 into the anchor 112. The acorn nut 124 is then removed from the hanger bolt 114 without loosening the hanger bolt 114 from the anchor 112. The hanger bolt 112 is now held firmly in place and is ready for receiving the retaining clip 18. The retaining clip 18 and antenna 12 are then mounted onto the stud 146 in the same manner as described above. Specifically, the retaining clip 18 is screwed onto the stud 146, the antenna 12 is snap-fit over the end of the retaining clip 18, and, if desired, a screwdriver or coin is used to screw the retaining clip 18 further onto the stud to draw the antenna 12 snug against the surface. It could be finger tightened.

Figure 6:
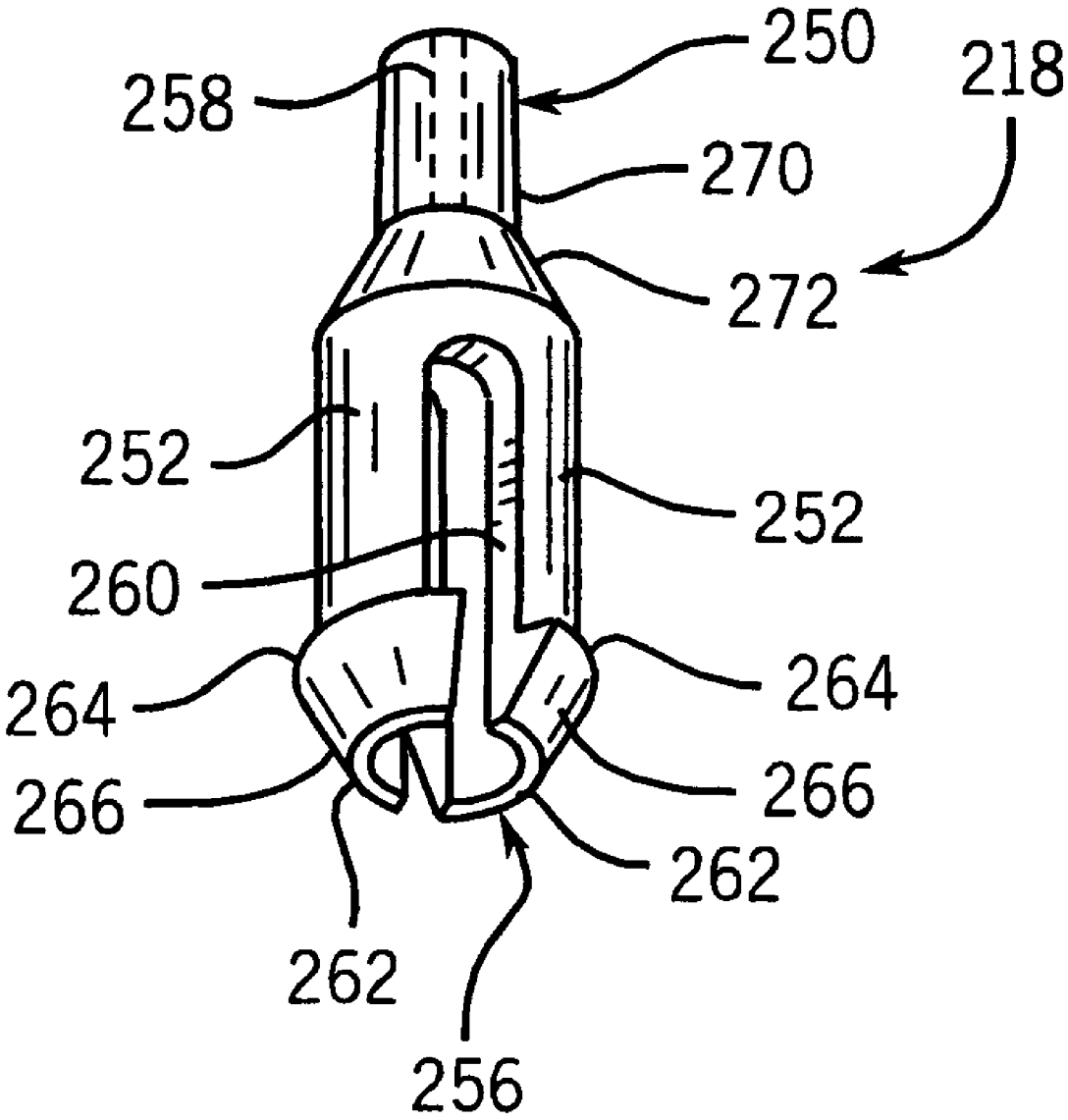
FIG. 6 is a perspective view of an alternative retaining clip usable in the retainers of FIGS. 1–5.

Referring now to FIG. 6, a retaining clip 218 is illustrated that is usable in any of the previous embodiments and that contains all the same general features as the retaining clip of the first embodiment. Clip 218 therefore includes a base portion 250 having a threaded internal base 258, a pair of prongs 252 separated by a slot 260, and a retention clip portion 256 having clip portions 262, lips 264, and finger pads 266. In fact, the most significant difference between the retainer clip 218 of this embodiment and the retaining clip 18 of the previous embodiment is that it is significantly wider at its lower end. The base 250 therefore is not continuously tapered. It instead includes an upper portion 270 of constant diameter and a lower, frusto-conical portion 272 that increases continuously in diameter from the lower end of the upper portion 270 to the upper end of the prongs 252. The slot 260 is also significantly wider than in the pervious embodiments. Finally, it has inclined finger pads 266 rather than concave pads.

The present invention has been described in terms of the preferred embodiment, and it is recognized that equivalents, alternatives, and modifications, aside from those expressly stated, are possible and within the scope of the appending claims.

We claim:

1. A retainer for mounting a device on a mounting surface, comprising:

an inner base portion having an inner bore engageable with a stud extending from the mounting surface;

a plurality of prongs extending outwardly from the base portion, the plurality of prongs being slidable into a bore of a device to be mounted to the mounting surface; and a retention clip formed by an outer distal end portion of the plurality of prongs and configured to retain the device on the mounting surface.

2. The retainer of claim 1 wherein the base portion further includes a frusto-conical portion having a relatively small diameter at an inner end thereof and a relatively large diameter at an outer end thereof.

3. The retainer of claim 1 wherein the plurality of prongs includes two prongs having outer distal ends that are compressibly spaced apart from one another.

4. The retainer of claim 3 further comprising a pair of finger pads at the outer distal ends of the prongs, each finger pad having a concave face to assist in compressing the two prongs to release the device from mounting surface.

5. The retainer of claim 1 wherein the retention clip includes a lip configured to engage an adjacent surface of the device.

6. The retainer of claim 1 wherein the mounting surface comprises a ceiling grid, and wherein the mounting structure further comprises a T-bar clip attachable to the ceiling grid and having the stud that is engageable with the inner bore of the base portion.

7. The retainer of claim 1 wherein the mounting surface comprises a ceiling tile, and further comprises a ceiling bracket that includes a stud extendable through the ceiling tile; T-bar clip that is engageable with the ceiling bracket and including the stud that is engageable with the inner bore of the base portion; and a ceiling washer and wing nut that are engageable to the stud of the ceiling bracket to mount the device to the mounting surface.

8. The retainer of claim 1 wherein the mounting surface comprises a solid surface, and further comprising an anchor inserted into the solid surface and a hanger bolt having an inner end attached to the anchor and having an outer end that forms the stud that is engageable with the inner bore of the base portion.

9. The mounting support of claim 1 wherein the plurality of prongs are elastic at their outer distal ends such that, when they are inserted into the bore of the device, the retention clip engages a chamfer on an outer edge of the bore of the device to retain the device with a snap-fit to the mounting surface.

10. A telemetry antenna mounting system comprising:

an antenna having a bore therethrough;

a support structure attachable to a surface and having a threaded stud extending therefrom; and a retaining clip comprising:

a base portion having a threaded inner bore engageable with the threaded stud of the support structure;

at least two prongs attached to, and extending downwardly from, the base portion, the at least two prongs being slidable into the bore of the antenna; and a retention clip formed with, and extending outwardly from, the at least two prongs to capture and retain the antenna to the surface.

11. The telemetry antenna mounting system of claim 10 wherein the support structure comprises a T-bar clip engageable to one of a ceiling grid and a ceiling grid-like bracket of a ceiling.

12. The telemetry antenna mounting system of claim 10 wherein the support structure includes a hanger bolt mounted on the surface.

13. The telemetry antenna mounting system of claim 12 wherein the support structure further comprises an anchor insertable into a hole drilled in the surface, and wherein the hanger bolt is threadedly engageable with the anchor and the retaining clip.

14. The telemetry antenna mounting system of claim 10 wherein the support structure includes a ceiling bracket attachable to a ceiling tile of a ceiling and a T-bar clip attachable to the ceiling bracket.

15. The telemetry antenna mounting system of claim 10 wherein the antenna is removable from the retaining clip upon compressing the plurality of prongs.

16. A method of mounting an antenna to a surface comprising the steps of:

securing a support structure to the surface, the support structure including a threaded stud;

screwing an internally threaded base portion of a retaining clip onto the threaded stud of the support structure;

sliding the antenna over a plurality of prongs attached to and extending from the base portion on a distal end of the retaining clip; and snap-locking the antenna to a retention clip attached to and extending outwardly from the plurality of prongs to retain the antenna to the surface.

17. The method of claim 16 wherein the step of securing the support structure to the surface comprises mounting a T-bar clip on the surface, a distal end of the T-bar clip forming the threaded stud.

18. The method of claim 17 wherein the step of mounting the T-bar clip on the surface comprises affixing the T-bar clip directly to a ceiling grid of a ceiling.

19. The method of claim 17 wherein the step of mounting the T-bar clip on the surface comprises attaching the T-bar clip to a support bracket that is mounted on a ceiling tile of a ceiling.

20. The method of claim 16 wherein the step of securing the support structure to the surface comprises attaching a hanger bolt to the surface, a distal end of the anchor bolt forming the threaded stud.

21. The method of claim 16 further comprising the step of compressing the plurality of prongs inwardly to disengage the antenna from the surface.

22. The method of claim 16 further comprising threading the retaining clip further onto the threaded post after snap-locking the antenna to the retaining clip to draw the antenna snug against the surface.

* * * * *